US006920932B2

(12) United States Patent
Zimmerman

(10) Patent No.: US 6,920,932 B2
(45) Date of Patent: Jul. 26, 2005

(54) JOINT FOR USE WITH EXPANDABLE TUBULARS

(75) Inventor: Patrick J. Zimmerman, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 69 days.

(21) Appl. No.: 10/408,748

(22) Filed: Apr. 7, 2003

(65) Prior Publication Data

US 2004/0194966 A1 Oct. 7, 2004

(51) Int. Cl.[7] ..... E21B 17/02
(52) U.S. Cl. ..... 166/380; 166/207; 166/195
(58) Field of Search ..... 166/207, 195, 166/117, 77.51, 380, 381

(56) References Cited

U.S. PATENT DOCUMENTS

| | | | | | |
|---|---|---|---|---|---|
| 4,281,858 | A | | 8/1981 | Bowyer | 285/39 |
| 4,423,889 | A | | 1/1984 | Weise | 285/39 |
| 4,601,492 | A | * | 7/1986 | George | 285/3 |
| 4,778,008 | A | | 10/1988 | Gonzalez | 166/387 |
| 5,348,095 | A | * | 9/1994 | Worrall et al. | 166/380 |
| 5,518,072 | A | | 5/1996 | McTernaghan | 166/115 |
| 5,901,789 | A | * | 5/1999 | Donnelly et al. | 166/381 |
| 6,142,230 | A | * | 11/2000 | Smalley et al. | 166/277 |
| 6,322,109 | B1 | * | 11/2001 | Campbell et al. | 285/92 |
| 6,457,532 | B1 | | 10/2002 | Simpson | 166/380 |
| 6,543,816 | B1 | | 4/2003 | Noel | |
| 6,607,220 | B2 | * | 8/2003 | Sivley, IV | 285/334 |
| 6,648,071 | B2 | * | 11/2003 | Hackworth et al. | 166/207 |
| 6,708,767 | B2 | * | 3/2004 | Harrall et al. | 166/382 |
| 2002/0163192 | A1 | | 11/2002 | Coulon et al. | |
| 2003/0029621 | A1 | | 2/2003 | Haynes | |

FOREIGN PATENT DOCUMENTS

| | | |
|---|---|---|
| GB | 2 033 942 | 5/1980 |
| WO | WO 01/60545 | 8/2001 |
| WO | WO 02/10551 | 2/2002 |

OTHER PUBLICATIONS

U.K. Search Report, Application No. GB0407784.8, dated Jul. 12, 2004.

* cited by examiner

*Primary Examiner*—Frank Tsay
(74) *Attorney, Agent, or Firm*—Moser, Patterson & Sheridan, L.L.P.

(57) ABSTRACT

Embodiments of the present invention generally relate to a joint used with expandable sand screens and other expandable tubulars that permits elongation or contraction of the expandable tubulars during a tubular expansion operation within a wellbore. In one aspect, a connection assembly for use with expandable tubulars is provided. The connection assembly includes a first expandable tubular axially fixable at one end within a wellbore and a second expandable tubular axially fixable at one end within the wellbore. The second expandable tubular has an opposite end adapted to receive an opposite end of the first expandable tubular to provide a joint between the tubulars. The connection assembly further includes a releasable connection between the opposite ends of the tubulars for selectively permitting axial movement of the opposite ends relative to each other. In another aspect, a method for joining a first expandable tubular and a second expandable tubular is provided. Furthermore, a method for substantially eliminating tension or compression forces within an expandable tubular string positioned in a wellbore is provided.

21 Claims, 3 Drawing Sheets

JOINT FOR USE WITH EXPANDABLE TUBULARS

BACKGROUND OF THE INVENTION

1. Field of the Invention

The present invention relates to expandable sand screens and other expandable tubulars. More particularly, the present invention relates to a joint used with expandable sand screens and other expandable tubulars that permits elongation or contraction of the expandable tubulars during a tubular expansion operation within a wellbore.

2. Description of Related Art

Hydrocarbon and other wells are completed by forming a borehole in the earth and then lining the borehole with steel pipe or casing to form a wellbore. After drilling a section of the wellbore, a string of casing is lowered into the wellbore and temporarily hung therein from the surface of the well. Using apparatus known in the art, the casing is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons. It is common to employ more than one string of casing in the wellbore and the subsequent strings (called "liners") usually extend back only far enough to overlap with the string thereabove.

Some wells are completed by perforating the casing (or liner) at selected depths where hydrocarbons are found. Hydrocarbons migrate from the formation, through the perforations, and into the cased wellbore. Alternatively, a lower portion of a wellbore may be left open by not lining it with casing, which is known as an open hole completion. To control particle flow from unconsolidated formations of the open hole completion, slotted tubulars or well screens are often employed downhole along the uncased portion of the wellbore. The sand screen is connected to the lower end of a production tubing that hydrocarbons travel through to the surface of the well.

Typically, an expandable sand screen is constructed from three composite layers that include a perforated base pipe, an intermediate filter media, and a perforated outer shroud. The filter media allows hydrocarbons to invade the wellbore, but filters sand and other unwanted particles from entering. A more particular description of an expandable sand screen is described in U.S. Pat. No. 5,901,789, which is incorporated herein by reference in its entirety. Expanding the sand screen into contact with the surrounding formation avoids the need for a gravel pack and increases the size of the wellbore at the level of producing sands. Typically, the expandable sand screen is expanded to a point where its outer wall places a stress on the wall of the wellbore, thereby providing support to the walls of the wellbore to prevent dislocation of particles. This preserves the integrity of the formation during production.

Expansion of an expandable sand screen, a slotted expandable tubular, or a solid expandable tubular may be accomplished by urging a cone-shaped object along the tubular's inner bore or by operating an expander tool having radially outward extending rollers that are fluid powered. A basic arrangement of a conical expander tool is disclosed in U.S. Pat. No. 5,348,095, which is incorporated herein by reference in its entirety. Pulling the expanded conical tool has the effect of expanding a portion of a tubular into sealed engagement with a surrounding formation wall, thereby sealing off the annular region therebetween. More recently, rotary expander tools have been developed. Rotary expander tools employ one or more rows of compliant rollers that are urged outwardly from a body of the expander tool in order to engage and to expand the surrounding tubular. The expander tool is rotated downhole so that the actuated rollers can act against the inner surface of the tubular to be expanded in order to expand the tubular body circumferentially. Radial expander tools are described in U.S. Pat. No. 6,457,532, which is incorporated herein by reference in its entirety. Therefore, expansion means like these provide outwardly radial forces that can expand and plastically deform either the expandable sand screen, the slotted expandable tubular, or the solid expandable tubular for any desired drilling, completion, or production operation. Since an expandable sand screen, a slotted expandable tubular, and a solid expandable tubular possess similar methods of radial expansion and differ mainly in their placement and function in the wellbore, the general term tubular or tubing encompasses all of these applications whether present in a tubular string or as a single tubular section.

Typically, a solid expandable tubular elongates as the metal or material forming the wall of the tubular is expanded radially outward during the expansion operation. The overall amount of elongation of the tubular string depends on factors such as the size of the annular gap and the length of the tubular string. This change in length of the tubular can cause compression of the tubular and present problems in certain instances. For example, buckling of the tubular can occur if the tubular's length increases while radially expanding the tubular from the top down when an end of the tubular string can not extend further to relieve compression due to its contact with a formation. The similar problem occurs when radially expanding from the bottom up while a top of the tubular string is anchored to casing or liner or necessarily held in place with a run-in tool.

On the other hand, an expandable sand screen with slotted tubulars typically shortens during the radial expansion in order to supply the necessary metal or material that comprises the increased diameter of the expanded tubular. This change in length of the tubular can cause tension within the tubular in certain instances. For example, a tubular may break during expansion if it is axially retained at both ends due to contact with a formation. Similarly, the tubular may be prevented from contracting in a bottom up radial expansion, due to the screen being anchored at an upper end to casing or liner.

These examples represent possible problems due to elongation and contraction of tubulars in a wellbore during expansion. However, other operations are envisioned that also fail to accommodate a length change in an expandable tubular as a result of the radial expansion thereof.

Therefore, there exists a need for apparatus and methods that compensate for tension and compression in a tubular string caused by elongation and contraction of tubulars being radially expanded in a wellbore. There exists a further need for a tool or joint that selectively permits axial movement of expandable tubulars in a wellbore in one or both directions when a load is applied thereto.

SUMMARY OF THE INVENTION

Embodiments of the present invention generally relate to a joint used with expandable sand screens, solid tubulars and other expandable tubulars that permits elongation or contraction of the tubulars during an expansion operation within a wellbore. In one aspect, a connection assembly for use with expandable tubulars is provided. The connection assembly includes a first expandable tubular axially fixable at one end within a wellbore and a second expandable tubular axially fixable at one end within the wellbore, the second expandable tubular having an opposite end adapted to receive an opposite end of the first expandable tubular to provide a joint between the tubulars. The connection assembly further includes a releasable connection between the opposite ends of the tubulars for selectively permitting axial movement of the opposite ends relative to each other.

In another aspect, a method for joining a first expandable tubular and a second expandable tubular is provided. The method includes inserting an end of the first expandable tubular into an end of the second expandable tubular to provide a connection. The method further includes securing the first expandable tubular to the second expandable tubular with a releasable connection, whereby the releasable connection is constructed and arranged to release at a predetermined axial force created during radial expansion of at least a portion of one of the expandable tubulars.

Further, a method for substantially eliminating tension or compression forces within an expandable tubular string positioned in a wellbore is provided. The method includes inserting at least one connection assembly in the expandable tubular string. The connection assembly comprising a first expandable tubular connected in a telescopic relation to a second expandable tubular and a releasable connection for selectively permitting axial movement, between the first expandable tubular and the second expandable tubular. The method further includes running the expandable tubular string into the wellbore and releasing the releasable connection by a predetermined axial force created while expanding radially at least a portion of the expandable tubular string. The method also includes sliding the first expandable tubular axially within the second expandable tubular to substantially eliminate the tension or compression forces.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the present invention generally relate to a method and an apparatus for connecting a first expandable tubular and a second expandable tubular using a joint that selectively permits axial movement between the tubulars in response to contraction or elongation of the tubulars due to their radial expansion.

Figure 1:
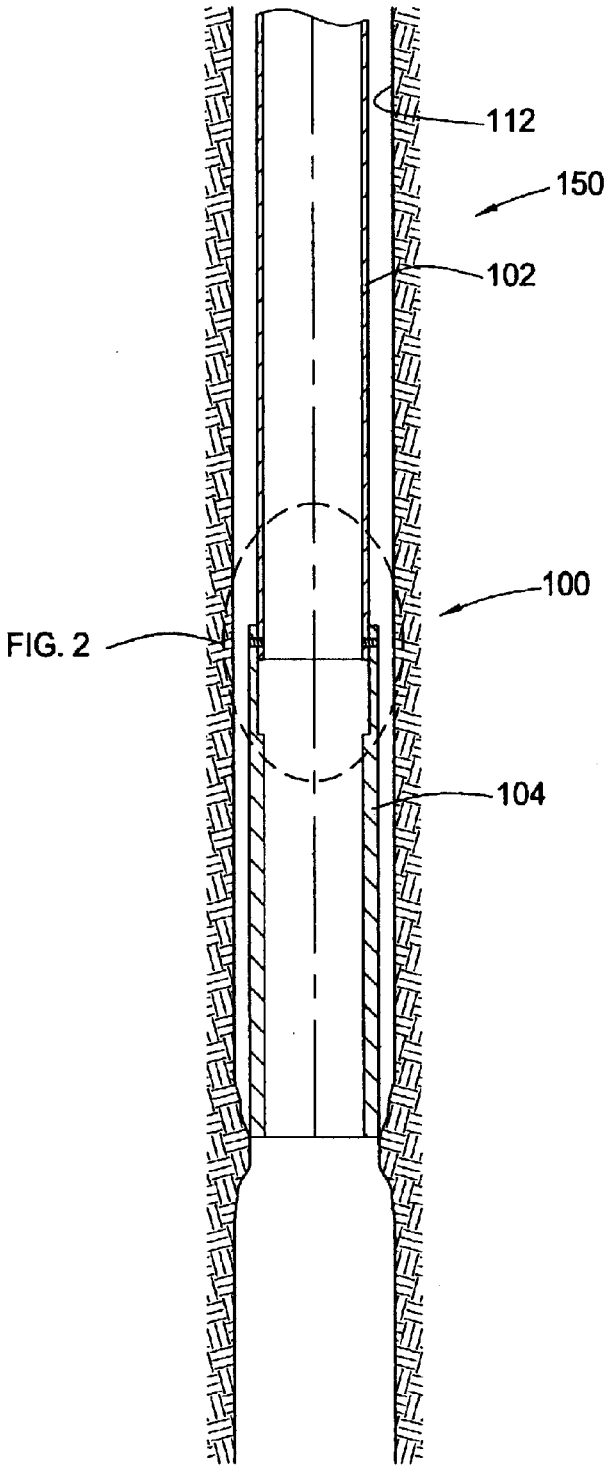
FIG. 1 is a cross-sectional view illustrating a string of tubulars disposed in a wellbore and showing one embodiment of the joint of the present invention.

FIG. 1 is a cross-sectional view illustrating a string of expandable tubulars 150 disposed in a wellbore 112 and showing one embodiment of the joint 100 of the present invention. Generally, a running assembly (not shown) connected to an upper end of the string of expandable tubulars 150 is used to place the string of expandable tubulars 150 in the wellbore 112. The string of expandable tubulars 150 is typically lowered to a predetermined point or until it contacts a restriction in the wellbore as illustrated in FIG. 1. In either case, the upper portion of the string of expandable tubulars 150 is secured in the wellbore 112 by an anchor (not shown) or by other means well known in the art. As depicted, the string of expandable tubulars 150 includes a first expandable tubular 102 and a second expandable tubular 104 connected at the joint 100.

Figure 2:
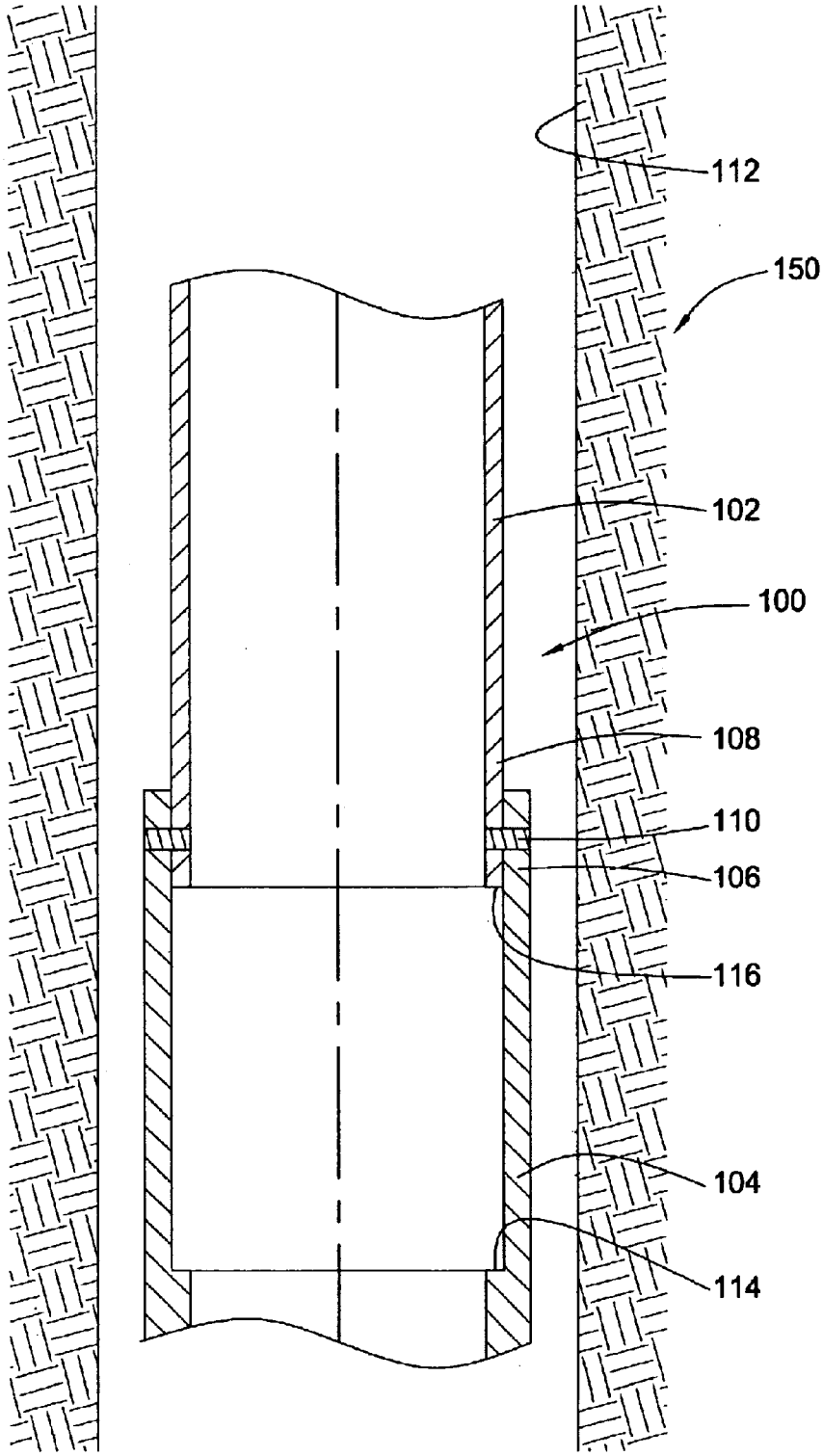
FIG. 2 is an enlarged cross-sectional view illustrating the joint in an unactuated position.

FIG. 2 is an enlarged cross-sectional view illustrating the joint 100 in an unactuated position. Generally, the joint 100 is used in the string of expandable tubulars 150 to connect the first expandable tubular 102 to the second expandable tubular 104. As illustrated, the joint 100 is located proximate the middle of the string of expandable tubulars 150. However, it should be noted that the joint can be used at any location in a tubular string. For example, the joint 100 may be employed at the terminal end of the string of expandable tubulars 150 to facilitate the expansion and isolate the joint from the expander tool.

As shown, the joint 100 comprises a female end 106 of the second expandable tubular 104 that has an inside diameter greater than an outside diameter of a male end 108 of the first expandable tubular 102. Thus, the female end 106 receives the male end 108. The male and female ends 106, 108 of the tubulars 104, 102 can have modified thickness so that the thickness of the joint 100 is substantially the same as the thickness of the walls of the tubulars adjacent the male and female ends 106, 108. Additionally, the male and female ends 106, 108 of the tubulars 104, 102 can have walls that are an expandable solid portion instead of expandable sand screen.

A releasable connection like a shear member 110 or shear ring or one or more shear pins positioned within apertures in the walls of the tubulars 102, 104 initially prevents axial movement between the tubulars 102, 104 while the joint 100 is in the run in position. The shear member 110 must be able to support the tension forces caused by the weight of the string of tubulars below the joint 100. In operation, the joint 100 remains in the run in position during run in and positioning of the string of expandable tubulars 150 within a wellbore 112 and until a portion of the string of expandable tubulars 150 is radially expanded.

As shown in FIG. 2, the apertures in the walls of the male end 108 and female end 106 align for placement of the shear member(s) 110. In the embodiment shown, the joint 100 permits axial movement between the tubulars 102, 104 when the connection is released, thereby allowing an end 116 on the male end 108 to contact a shoulder 114 in the female end 106. In this manner, the length of the string of expandable tubulars 150 is reduced. However, in another embodiment, the apertures that the shear member 110 are inserted into can be positioned within the walls of the tubulars so that the shear member 110 initially secures the male end 108 within the female end 106 at an intermediate position so that the joint 100 can provide axial movement between the tubulars 102, 104 in either direction thereby, permitting the length of the string of expandable tubulars 150 to lengthen or shorten.

Figure 3:
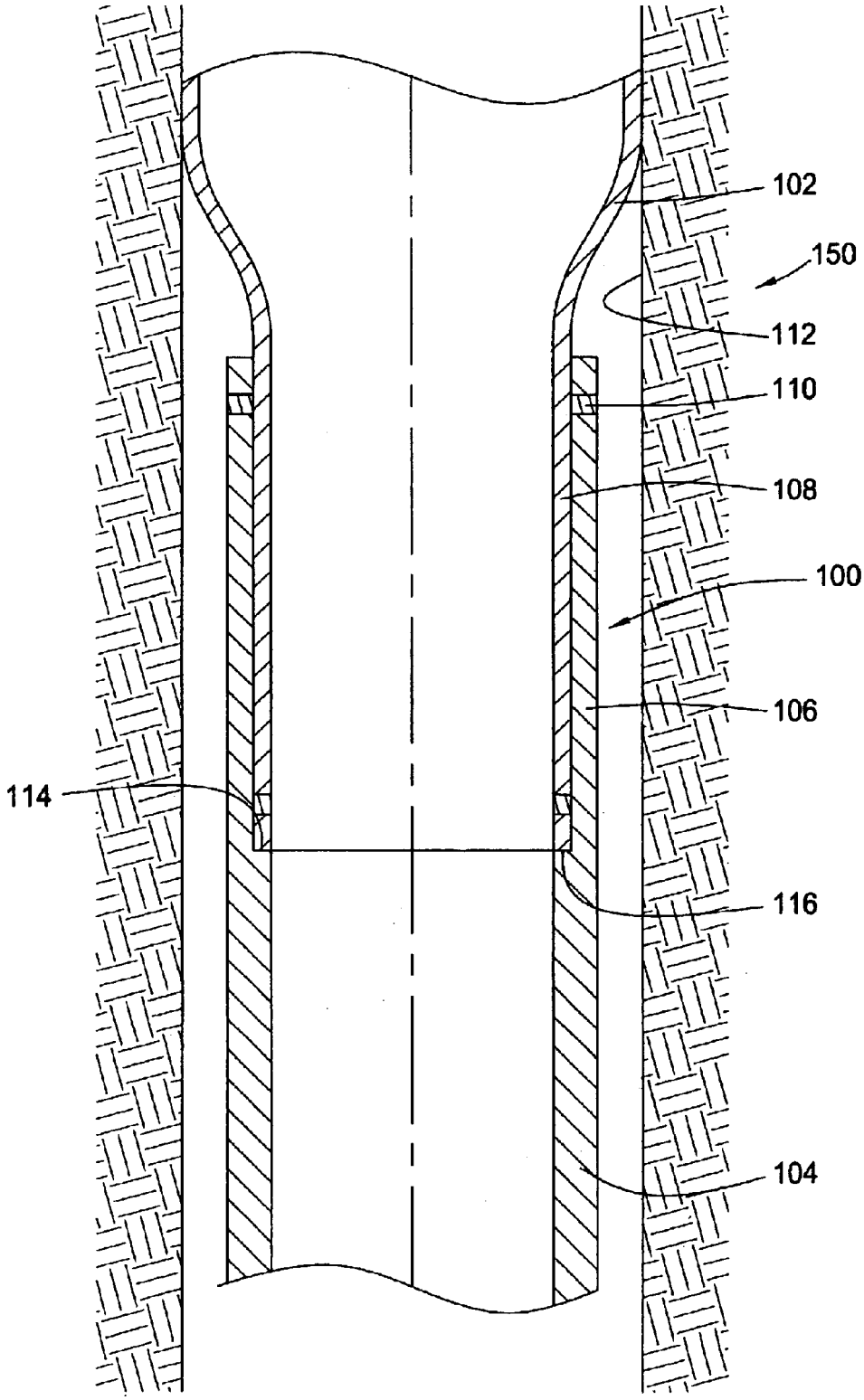
FIG. 3 is an enlarged cross-sectional view illustrating the joint in an actuated or retracted position.

FIG. 3 is an enlarged cross-sectional view illustrating the joint 100 in an actuated or retracted position. Typically, an expander tool (not shown) has radially expanded a portion of the first expandable tubular 102, possibly into contact with the wellbore 112. During the radial expansion, the length of the first expandable tubular 102 lengthens as is the case with solid tubulars. As previously described, the first expandable tubular 102 is typically axially fixed in the wellbore 112 by an anchor or a run in tool and/or by its contact with the wellbore 112. Additionally, either weight of the string of expandable tubulars 150 below the joint 100 or contact of a lower end of the string of expandable tubulars 150 with the wellbore 112 may substantially prevent axial movement of the second expandable tubular 104 within the wellbore 112. Thus, tension takes place as the string begins to lengthen, creating an axial force at the joint 100. At a predetermined force, the shear member 110 fails and permits the male end 108 to slide within the female end 106 towards the shoulder 114. In this manner, the joint 100 permits compensation for lengthening of the string due to radial expansion.

In another embodiment, the joint 100 of the present invention may be employed in a string of expandable sand screen tubulars (not shown). Generally, the joint is used to connect a first sand screen tubular (not shown) to a second sand screen tubular (not shown). Thereafter, an expander tool (not shown) is used to radially expand at least the first sand screen tubular into contact with the wellbore. As discussed herein, during the radial expansion, the length of a sand screen tubular is reduced. By arranging the joint to permit its members to side away from each other in opposite directions, the joint can compensate for the shortening of the sand screen as expansion takes place. For example, when the screen is run into the wellbore, the joint is arranged whereby the pieces are held in a retracted position by a releasable member, like the shearable member described herein. Thereafter, when expansion takes place and the string is put into tension, the releasable member is deigned to fail and the male and female portions of the joint move away form one another, thereby compensating of the reduction in length within the tubular string of screen. As described herein, the joint especially useful when a string of sand screen is axially prevented form movement at both ends or in the case where and operator does not which either end of the string to become repositioned relative to the wellbore after expansion.

In another embodiment, the joint 100 of the present invention may be employed for use with solid expandable tubulars (not shown) that includes a first expandable tubular with a stinger (not shown) end or male end positioned within an elongated polished bore receptacle (not shown) or female end of a second expandable tubular. The elongated polished bore receptacle is of substantial axial length to accommodate the maximum amount of elongation of the tubing string that occurs due to the radial expansion of the tubular string. A plurality of axially spaced sets of axially stacked seals are conventionally mounted on an outside surface of the stinger end in order to provide a sealing relationship between the outside of the stinger end and the inside surface of the polished bore receptacle. Examples of suitable seals include v-type ring seals or bonded seals, which are both well known in the art.

In the run-in position of the joint, the stinger end is initially prevented from axial movement relative to the polished bore receptacle by one or more shear members which pass through the wall of the polished bore receptacle. The shear member prevents substantial movement of the stinger end relative to the polished bore receptacle until sufficient compression force is exerted on the stinger end by the tubing string to shear the shear pin and permit an end of the stinger end to move closer to a shoulder of the polished bore receptacle.

As an expander tool (not shown) radially expands the first expandable tubular into contact with the wellbore, the length of the first expandable tubular elongates. However, the first expandable tubular is axially fixed in the wellbore by an anchor (not shown) and/or by its contact with the wellbore. Additionally, either contact of the terminal end of the string of expandable tubulars with the formation at an end of the wellbore or an anchor such as a partial radial expansion near the terminal end of the string of expandable tubulars may substantially prevent axial movement of the second expandable tubular within the wellbore. Thus, the elongation of the first expandable tubular causes compression force across the joint. At a predetermined compression force, the shear member severs and permits the stinger end to slide within the polished bore receptacle. In this manner, the joint permits the first expandable tubular to elongate due to its radial expansion. The seals are dynamic and substantially seal between the stinger end and the polished bore receptacle during movement therebetween. However, the seals become static seals once the expander tool expands the portion of the joint having the seals therein.

For any embodiment of the joint 100, one or more joints can be positioned at the bottom, top, or at any other location within a string of expandable tubulars. The overall length of the joint 100 can in some instances be at least twenty feet based on the number of other joints used in the string of expandable tubulars and the expected amount of contraction or elongation of the string of tubulars. Additionally, the joint 100 can be used in place of conventional threaded connections during make-up of the string of expandable tubulars. Therefore, the shear members 110 closest to the terminal end of the tubular string can be provided to shear at less axial stress since these shear members must support less of the weight of the tubular string.

Eliminating a strain within an expandable tubular string and joining two expandable tubulars can be accomplished with methods that use embodiments of the joint as described above. A method for joining a first expandable tubular and a second expandable tubular includes inserting an end of the first expandable tubular into an end of the second expandable tubular to provide a joint, and securing the first expandable tubular to the second expandable tubular with a shear member that is designed and adapted to shear from loads caused by axial tension or compression during radial expansion of at least a portion of one of the expandable tubulars. Further, a method for substantially eliminating an axial strain within an expandable tubular string includes running the expandable tubular string into the wellbore, expanding radially at least a portion of the expandable tubular string, severing at least one shear member of at least one joint within the tubular string by a predetermined compression or tension force produced by elongation or contraction of the tubular string, and sliding a first tubular axially relative to a second tubular at the joint to substantially eliminate the tension or compression forces. Therefore, the apparatus and methods disclosed herein for using embodiments of the joints with expandable tubulars prevents compression and tension forces that threaten the mechanical integrity of the tubing string.

While the foregoing is directed to embodiments of the present invention, other and further embodiments of the invention may be devised without departing from the basic scope thereof, and the scope thereof is determined by the claims that follow. For example, both tubulars need not be expandable. Alternatively, one tubular could be a slotted tubular end and the other could be a solid tubular, either or both of which is expandable.

What is claimed is:

1. A connection assembly for use with expandable tubulars, comprising:

a first expandable tubular axially fixable at one end within a wellbore;

a second expandable tubular axially fixable at one end within the wellbore, the second expandable tubular having an opposite end adapted to receive an opposite end of the first expandable tubular to provide a joint between the tubulars; and a releasable connection between the opposite ends of the tubulars for selectively permitting axial movement of the opposite ends relative to each other during expansion of at least a portion of one of the expandable tubulars.

2. The connection assembly of claim 1, wherein at least one of the expandable tubulars is a sand screen, the axial length reduceable upon expansion of the screen.

3. The connection assembly of claim 1, wherein the end on the first expandable tubular comprises a female end and the end on the second expandable tubular comprises a male end.

4. The connection assembly of claim 1, wherein radial expansion of the first expandable tubular creates an axial force.

5. The connection assembly of claim 4, wherein the releaseable connection fails at at a predetermined axial force allowing a portion of the first expandable tubular to move axially.

6. The connection assembly of claim 1, wherein radial expansion of the second expandable tubular creates an axial force.

7. The connection assembly of claim 6, wherein the releaseable connection fails at a predetermined axial force allowing a portion of the second expandable tubular to move axially.

8. A method for joining a first expandable tubular and a second expandable tubular, comprising:

inserting an end of the first expandable tubular into an end of the second expandable tubular to provide a connection; and securing the first expandable tubular to the second expandable tubular with a releasable connection, whereby the releasable connection is constructed and arranged to release at a predetermined axial force created during radial expansion of at least a portion of one of the expandable tubulars to allow axial movement of the tubulars relative to each other.

9. The method of claim 8, wherein at least one of the expandable tubulars is a sand screen.

10. The method of claim 8, wherein the end on the first expandable tubular comprises a female end and the end on the second expandable tubular comprises a male end.

11. A method for substantially eliminating tension or compression forces within an expandable tubular string positioned in a wellbore, comprising:

inserting at least one connection assembly in the expandable tubular string, the connection assembly comprising:

a first expandable tubular connected in a telescopic relation to a second expandable tubular; and a releasable connection for selectively permitting axial movement between the first expandable tubular and the second expandable tubular;

running the expandable tubular string into the wellbore;

releasing the releasable connection by a predetermined axial force created while expanding radially at least a portion of the expandable tubular string; and sliding the first expandable tubular axially within the second expandable tubular to substantially eliminate the tension or compression forces.

12. The method of claim 11, wherein at least one of the expandable tubulars is a sand screen.

13. The method of claim further 11, further including anchoring one end of the first expandable tubular and one end of the second expandable tubular in the wellbore.

14. The method of claim 11, wherein the end on the first expandable tubular comprises a female end and the end on the second expandable tubular comprises a male end.

15. The method of claim 11, wherein a plurality of seals are disposed around the end of the first expandable tubular.

16. A method of compensating for a change in length of a tubular sting during expansion, comprising:

providing a joint in the string, the joint initially retained at an initial length by a shearable connection; and providing an axial force on the joint in a wellbore, thereby causing the joint to move to a second length to compensate for the change in length of the string.

17. A connection assembly for use with expandable tubulars, comprising:

a first expandable tubular axially fixable at one end within a wellbore;

a second expandable tubular axially fixable at one end within the wellbore, the second expandable tubular having an opposite end adapted to receive an opposite end of the first expandable tubular to provide a joint between the tubulars; and a shear pin between the opposite ends of the tubulars for selectively permitting axial movement of the opposite ends relative to each other.

18. A connection assembly for use with expandable tubulars, comprising:

a first expandable tubular axially fixable at one end within a wellbore;

a second expandable tubular axially fixable at one end within the wellbore, the second expandable tubular having an opposite end adapted to receive an opposite end of the first expandable tubular to provide a joint between the tubulars;

a releasable connection between the opposite ends of the tubulars for selectively permitting axial movement of the opposite ends relative to each other; and a plurality of seals disposed around the end of the first expandable tubular.

19. The connection assembly of claim 17, the plurality of seals comprises v-type ring seals.

20. A method for joining a first expandable tubular and a second expandable tubular, comprising:

inserting an end of the first expandable tubular into an end of the second expandable tubular to provide a connection; and securing the first expandable tubular to the second expandable tubular with a shear pin, whereby the shear pin is constructed and arranged to release at a predetermined axial force created during radial expansion of at least a portion of one of the expandable tubulars.

21. A method for joining a first expandable tubular and a second expandable tubular, comprising:

inserting an end of the first expandable tubular into an end of the second expandable tubular to provide a connection, wherein a plurality of seals are disposed around the end of the first expandable tubular; and securing the first expandable tubular to the second expandable tubular with a releasable connection, whereby the releasable connection is constructed and arranged to release at a predetermined axial force created during radial expansion of at least a portion of one of the expandable tubulars.

* * * * *

UNITED STATES PATENT AND TRADEMARK OFFICE

CERTIFICATE OF CORRECTION

PATENT NO. : 6,920,932 B2
APPLICATION NO. : 10/408748
DATED : April 7, 2003
INVENTOR(S) : Patrick J. Zimmerman It is certified that error appears in the above-identified patent and that said Letters Patent is hereby corrected as shown below:

In column 7, Claim 5, line 22, please delete "at" after "at,"

In column 8, Claim 16, line 9, please delete "sting" and insert --string--.

In column 8, Claim 19, line 42, please delete "17," and insert --18, wherein--.

Signed and Sealed this

Third Day of October, 2006

JON W. DUDAS
*Director of the United States Patent and Trademark Office*

UNITED STATES PATENT AND TRADEMARK OFFICE

CERTIFICATE OF CORRECTION

PATENT NO. : 6,920,932 B2
APPLICATION NO. : 10/408748
DATED : July 26, 2005
INVENTOR(S) : Patrick J. Zimmerman It is certified that error appears in the above-identified patent and that said Letters Patent is hereby corrected as shown below:

In column 7, Claim 5, line 22, please delete "at" after "at".

In column 8, Claim 16, line 9, please delete "sting" and insert --string--.

In column 8, Claim 19, line 42, please delete "17," and insert --18, wherein--.

This certificate supersedes Certificate of Correction issued October 3, 2006.

Signed and Sealed this

Seventh Day of November, 2006

JON W. DUDAS
*Director of the United States Patent and Trademark Office*